US007896681B2

(12) United States Patent
Stephens et al.

(10) Patent No.: US 7,896,681 B2
(45) Date of Patent: Mar. 1, 2011

(54) RJ MODULAR CONNECTOR

(75) Inventors: Michael Stephens, Glen Allen, VA (US); Kyle Dean Hedrick, Midlothian, VA (US)

(73) Assignee: Greenlee Textron Inc., Rockford, IL (US)

( * ) Notice: Subject to any disclaimer, the term of this patent is extended or adjusted under 35 U.S.C. 154(b) by 0 days.

(21) Appl. No.: 12/849,875

(22) Filed: Aug. 4, 2010

(65) Prior Publication Data

US 2010/0297870 A1 Nov. 25, 2010

Related U.S. Application Data

(62) Division of application No. 12/366,727, filed on Feb. 6, 2009, now Pat. No. 7,789,694.

(60) Provisional application No. 61/026,856, filed on Feb. 7, 2008.

(51) Int. Cl.
*H01R 13/625* (2006.01)

(52) U.S. Cl. ..... 439/344; 439/392

(58) Field of Classification Search ..... 439/399–401, 439/404, 405, 344, 425, 392
See application file for complete search history.

(56) References Cited

U.S. PATENT DOCUMENTS 5,996,224 A 12/1999 Sullivan
6,017,237 A 1/2000 Sullivan
6,105,229 A 8/2000 Sullivan
6,368,143 B1 * 4/2002 Adams ..... 439/418
7,241,162 B1 7/2007 Lawrence

OTHER PUBLICATIONS

United States Patent Office; U.S. Appl. No. 12/366,727 Office Action; mailing date Apr. 21, 2010.

* cited by examiner

*Primary Examiner*—Ross N Gushi
(74) *Attorney, Agent, or Firm*—Thomas & Karceski, PC

(57) ABSTRACT

An RJ modular connector is provided that has wire channels that slope downward and end at openings in the bottom of the connector through which the stripped wires extend. In use, the outer jacket insulation is removed from an end portion of the cable, leaving lengths of exposed wires. The length of the exposed wire is unimportant. The wires are arranged in an essentially flat configuration and inserted longitudinally into the connector and then directed downward by the downward slope of the channels, so that the distal ends of the respective wires extend through the bottom of the connector. The protruding wire ends are then compared with a standard to confirm the correct color identification pattern for them and corresponding wire position. After the comparison is made, the protruding wire ends are crimped/secured and sheared off. Conductive contact blades are inserted, and pierce the wires.

21 Claims, 5 Drawing Sheets

RJ MODULAR CONNECTOR

CROSS-REFERENCE TO RELATED APPLICATIONS

This application is a divisional of and claims priority to U.S. application Ser. No. 12/366,727, filed Feb. 6, 2009, now U.S. Pat. No. 7,789,694 which in turn claims priority to U.S. Provisional Application No. 61/026,856, filed Feb. 7, 2008, the contents of which are incorporated herein by reference.

FIELD OF THE INVENTION

The present invention relates to RJ type modular connectors and tools and methods for using RJ type modular connectors.

BACKGROUND OF THE INVENTION

The typical process for terminating twisted-pair cables with a modular connector involves first stripping a prescribed portion of the insulating jacket of the cable, exposing the individual pairs of twisted insulated wires. Then, the pairs are untwisted and aligned in a formation consistent with the modular connector's receiving opening (usually in flat formation). Next, the wires are inserted into the connector, visually inspected, then crimped with a tool specific for this application.

Several challenges are often present when terminating twisted-pair cables. One, as described above, the wires typically must be untwisted to some extent before inserting into the connector and terminating. It is difficult to avoid removing too much insulation and/or untwisting too much wire, thus increasing the risk of "cross-talk" (including "near end cross talk"). Additionally, it can be difficult to visually verify the correct position of each wire once inserted into the connector, due to the need to cut the individual wires to a predetermined, very short length.

To overcome these challenges, technicians are provided standards to minimize the untwisted portion of the cable and given dimensional guidelines to adhere to. Also, to help visual inspection, the wire pairs are color coded and connectors are typically manufactured out of clear plastic. These measures help; however, difficulties still exist, particularly for lesser experienced technicians.

One known connector and associated crimping tool addresses most of these issues by providing a connector that has openings in the front face of the connector such that the wires can extend through it before they are cut off. The outer jacket insulation is removed from an end portion of the cable, leaving much greater lengths of exposed wires. The wires are arranged in an essentially flat configuration and inserted longitudinally into and through the connector, so that the respective wires extend through separate tracks and their end portions protrude from the forward end of the connector. This connector design allows the individual wires to be pulled all the way through the connector. The complementary tool includes a blade that shears the protruding wires flush with the connector in the process of crimping. However, the ends of the sheared wires are left exposed, therefore, subject to "cross-talk", corrosion, and/or other detrimental effects.

BRIEF SUMMARY OF THE INVENTION

In embodiments of the present invention, an RJ modular connector is provided that has wire channels that slope upward and end at openings in the top of the connector through which the stripped wires extend. In use, the outer jacket insulation is removed from an end portion of the cable, leaving lengths of exposed wires. The length of the exposed wire is unimportant. The wires are arranged in an essentially flat configuration and inserted longitudinally into the connector and then directed upward by the upward slope of the channels, so that the distal ends of the respective wires extend through the top of the connector. The protruding wire ends are then compared with a standard to confirm the correct color identification pattern for them and corresponding wire position. After the comparison is made, the protruding wire ends are crimped/secured and sheared off. Conductive contact blades are inserted, and pierce the wires.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

As shown in FIGS. 1-5 by way of example, an illustration of one type of device that would benefit from the present invention is provided. In embodiments of the present invention, an RJ modular connector is provided that has wire channels that slope upward and end at openings in the top of the connector through which the stripped wires extend. In use, the outer jacket insulation is removed from an end portion of the cable, leaving lengths of exposed wires. The length of the exposed wire is unimportant. The wires are arranged in an essentially flat configuration and inserted longitudinally into the connector and then directed upward by the upward slope of the channels, so that the distal ends of the respective wires extend through the top of the connector. The protruding wire ends are then compared with a standard to confirm the correct color identification pattern for them and corresponding wire position. After the comparison is made, the protruding wire ends are crimped/secured and sheared off as discussed in more detail below.

Figure 1A:
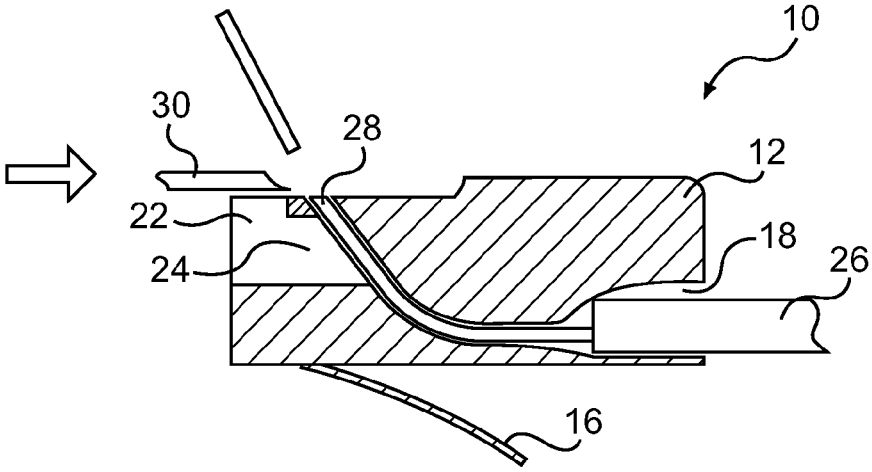
FIG. 1A is a cross-sectional side view of a RJ modular connector, in accordance with embodiments of the present invention.
Figure 1B:
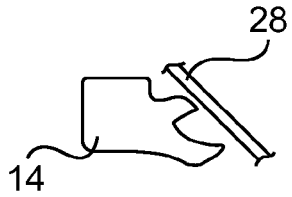
FIG. 1B illustrates the relationship between a contact blade of the connector of FIG. 1A and an individual wire of the twisted pair cable.
Figure 1C:
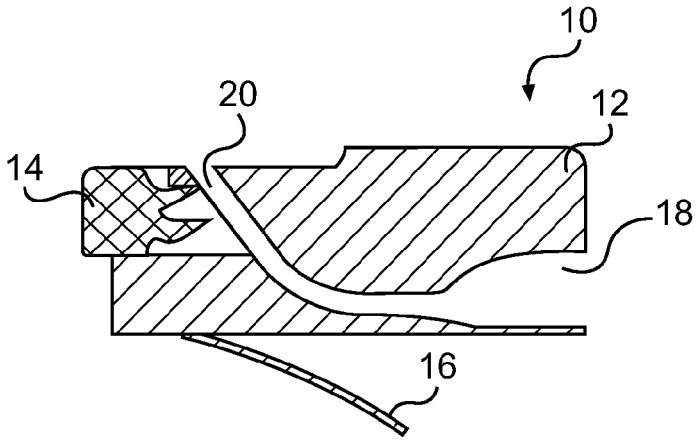
FIG. 1C is a cross-sectional side view of the connector of FIG. 1A, illustrating a contact blade in an un-crimped position and typical cable entry.

Referring now to FIGS. 1A-C, a modular connector 10 for terminating an insulated cable is illustrated. The insulated cable 26 has a jacket encasing a plurality of insulated wires 28. The modular connector 10 has a generally rectangular parallelepiped shape. The connector has a connector body 12. Defined within the connector body is an internal cavity, the internal cavity comprising (i) a rearward chamber 18 for receiving a portion of the insulated cable via an opening defined in the rear wall and (ii) a plurality of substantially parallel passages 20 (one of which is illustrated) for receiving the insulated wires. Each of the parallel passages extends from the rearward chamber 18 to a respective one of a plurality of openings 74 (seen more clearly in FIG. 1F) defined in the top of the connector body.

Also defined within the connector body are a plurality of slots 22. Each is open to the front wall and to the top of the connector body. Each slot is substantially parallel to the side walls of the connector body. Each slot is configured to receive a respective one of a plurality of conductive contact blades 14 inserted in a direction along a longitudinal axis of the connector. Each conductive contact blade 14 has at least one piercing point (two piercing points are illustrated in the figures). Each slot 22 has an opening 24 to a respective one of the parallel passages to allow the piercing points to reach and pierce a respective insulated wire when the contact blade is fully inserted.

As with known modular connectors, the underside of the connector body has a resilient release lever 16, which is releasably engageable with the jack into which the connector is inserted.

In the embodiments illustrated in FIGS. 1A, 1C, 1E, 2B, and 2C, the parallel passages meet the top of the connector body at an angle (which may be, for example, between five degrees and ninety degrees). In such embodiments, the length of each contact blade piercing point is selected such that each piercing point pierces the respective insulated wire to about the same depth. In other words, the length of the piercing points will typically be unequal in such embodiments. This unequal length is most clearly illustrated in FIG. 1B.

Figure 1D:
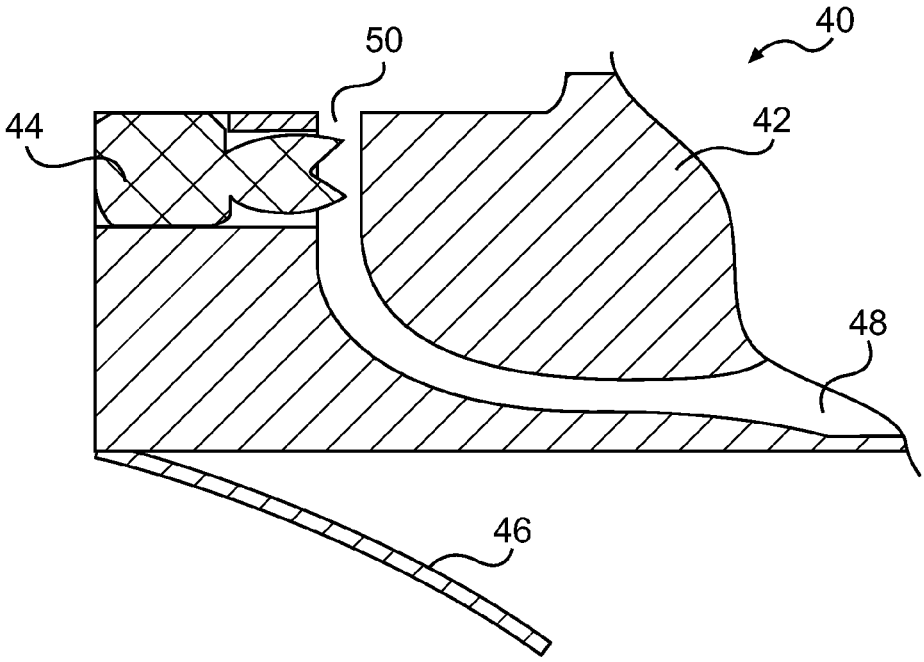
FIG. 1D is a close-up cross-sectional side view of a portion of the connector of FIG. 1A, illustrating a contact blade in a crimped position.

In the embodiments illustrated in FIG. 1D, connector 40 comprises a connector body 42, in which an internal cavity is defined. The internal cavity of connector 40 comprises (i) a rearward chamber 48 for receiving a portion of the insulated cable via an opening defined in the rear wall and (ii) a plurality of substantially parallel passages 50 (one of which is illustrated) for receiving the insulated wires. In connector 40, the parallel passages 50 meet the top of the connector body at a substantially perpendicular angle. In such embodiments, the piercing points of the contact blade 44 have substantially equal lengths to enable each piercing point to pierce the respective insulated wire to about the same depth. As with the connector of FIGS. 1A and 1B, connector 40 of FIG. 1D comprises a plurality of slots for receiving contact blades 44. As with other connectors of this type, connector 40 has a resilient release lever 46.

Figure 1E:
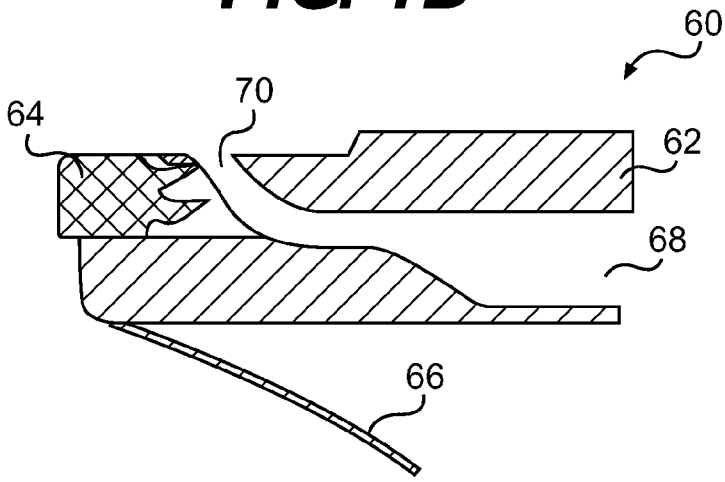
FIG. 1E is a cross-sectional side view of a RJ modular connector, in accordance with alternative embodiments of the present invention, illustrating a contact blade in an un-crimped position and an alternate channel configuration.

In the embodiments illustrated in FIG. 1E, connector 60 comprises a connector body 62, in which an internal cavity is defined. The internal cavity of connector 60 comprises (i) a rearward chamber 68 for receiving a portion of the insulated cable via an opening defined in the rear wall and (ii) a plurality of substantially parallel passages 70 (one of which is illustrated) for receiving the insulated wires. In connector 60, the internal cavity has an alternative configuration in which the parallel passages 70 intersect the rearward passage at or near the top of the rearward passage. As with the connector of FIGS. 1A and 1B, connector 60 of FIG. 1E comprises a plurality of slots for receiving contact blades 64. As with other connectors of this type, connector 60 has a resilient release lever 66.

Figure 1F:
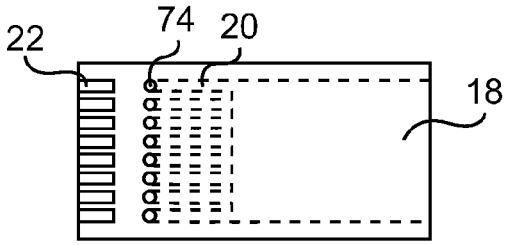
FIG. 1F is a top view of the connector of FIG. 1A, illustrating the large channel to receive the unstripped cable and the small channels to receive the stripped wires.

In embodiments of the invention illustrated in FIGS. 1A-F, 2A-C, and 3, the wires emerge from the top and a shearing force is applied along the longitudinal axis (see arrow in FIG. 1A). The shearing force is applied in this embodiment by a crimping tool (not illustrated) which simultaneously shears the wire ends (such as with a blade 30) while crimping a portion of the connector surrounding the cable in order to secure the cable. Contact blades (one for each wire) pierce the insulation of each individual wire (when fully inserted) and provide the electrical connection from the wires to the wall jack. The contact blades are inserted horizontally—parallel to the longitudinal axis into the front face (see arrow in FIG. 1C). The crimping tool seats the contact blades into position, driving the prongs into the wire channels and thus into the wires. FIG. 1C illustrates a contact blade in a partially inserted, un-crimped position, and FIG. 1D illustrates a contact blade in a fully inserted, crimped position. Due to the slope of the inserted wire, the contact blade may have uneven prongs (see FIG. 1B). FIG. 1F illustrates the large channel that receives the unstripped cable and the small channels that receive the stripped wires, as well as the sockets that receive the contact blades. FIG. 1F illustrates eight small channels, but the actual number of small channels will vary depending on the specific cable used and the specific application.

Figure 2A:
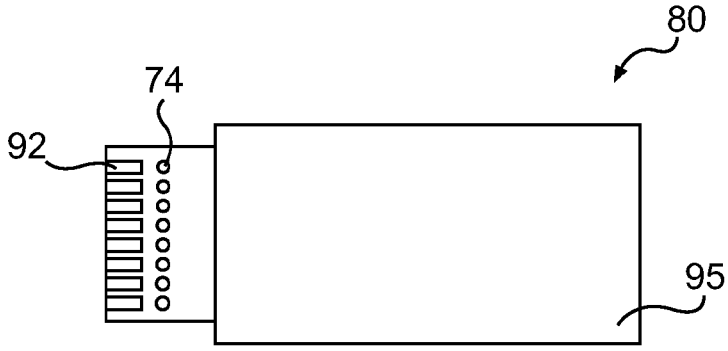
FIG. 2A is a top view of a RJ modular connector, in accordance with alternative embodiments of the present invention.
Figure 2B:
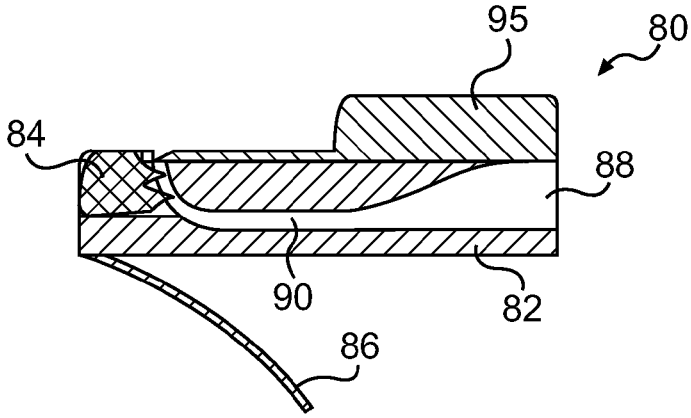
FIG. 2B is a cross-sectional side view of the connector of FIG. 2A, illustrating the top shearing element in a closed/crimped position.
Figure 2C:
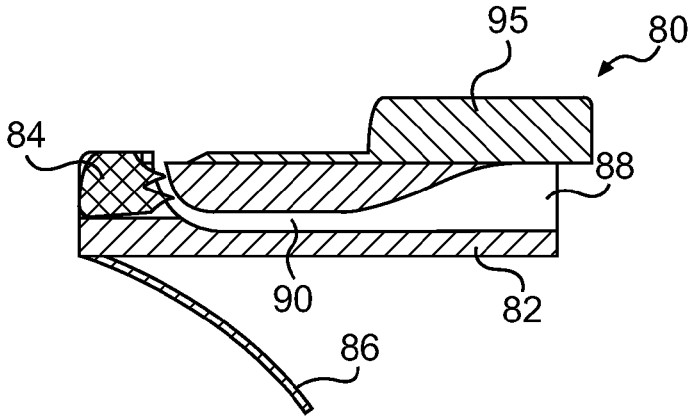
FIG. 2C is a cross-sectional side view of the connector of FIG. 2A, illustrating the top shearing element in an open/un-crimped position.
Figure 3:
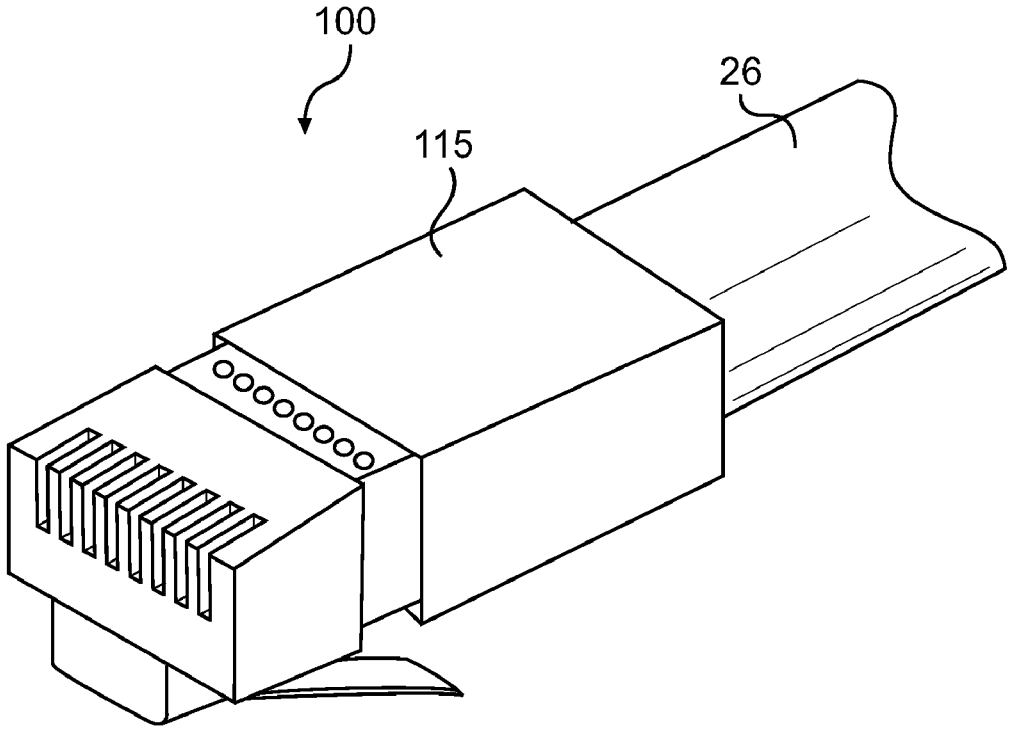
FIG. 3 is a top perspective view of a RJ modular connector, in accordance with alternative embodiments of the present invention.

In alternative embodiments, the connector includes a sliding mechanism that is slidably engaged with the connector body. The sliding mechanism is configured to cover the plurality of openings defined in the top of the connector body when in a closed position and to enable the free end of each of the insulated wires to protrude from the openings when in an open position. The sliding mechanism may include a shearing edge for shearing the protruding insulated wires when the sliding mechanism is moved from the open position to the closed position. FIGS. 2A-C illustrates an embodiment having a sliding top surface, while FIG. 3 illustrates an embodiment with a sliding outer sleeve. In the embodiment illustrated in FIGS. 2A-C, connector 80 comprises a connector body 82, in which an internal cavity is defined. The internal cavity of connector 80 comprises (i) a rearward chamber 88 for receiving a portion of the insulated cable via an opening defined in the rear wall and (ii) a plurality of substantially parallel passages 90 (one of which is illustrated) for receiving the insulated wires. The parallel passages 90 extend from the rearward chamber 88 to the holes 74 in the top of the connector body. Connector 80 has a sliding top mechanism 95. FIGS. 2A and 2C illustrate the sliding mechanism in an open position, while FIG. 1B illustrates the sliding mechanism in a closed position. As with the connector of FIGS. 1A and 1B, connector 80 of FIGS. 2A-C comprises a plurality of slots 92 for receiving contact blades 84. As with other connectors of this type, connector 80 has a resilient release lever 86.

Connector 100 of FIG. 3 has a sliding outer sleeve 115 that shears the protruding wires and covers the holes. The sleeve 115 partially surrounds at least the top and the side walls of the connector body. As seen in FIGS. 2B, 2C and 3, the top of the connector body may have a shoulder parallel to the front wall, such that a forward end of the sliding mechanism abuts a vertical portion of the shoulder when the sliding mechanism is in a closed position.

FIGS. 2B and 2C illustrate an exaggerated beveled edge, but only a slightly angled edge is typically required. In the embodiment of FIG. 3, the outer dimensions of the forward end of the connector and the outer dimensions of the sliding outer sleeve are substantially the same, such that a uniform outer surface results when the outer sleeve is slid forward into the closed/crimped position.

Figure 4:
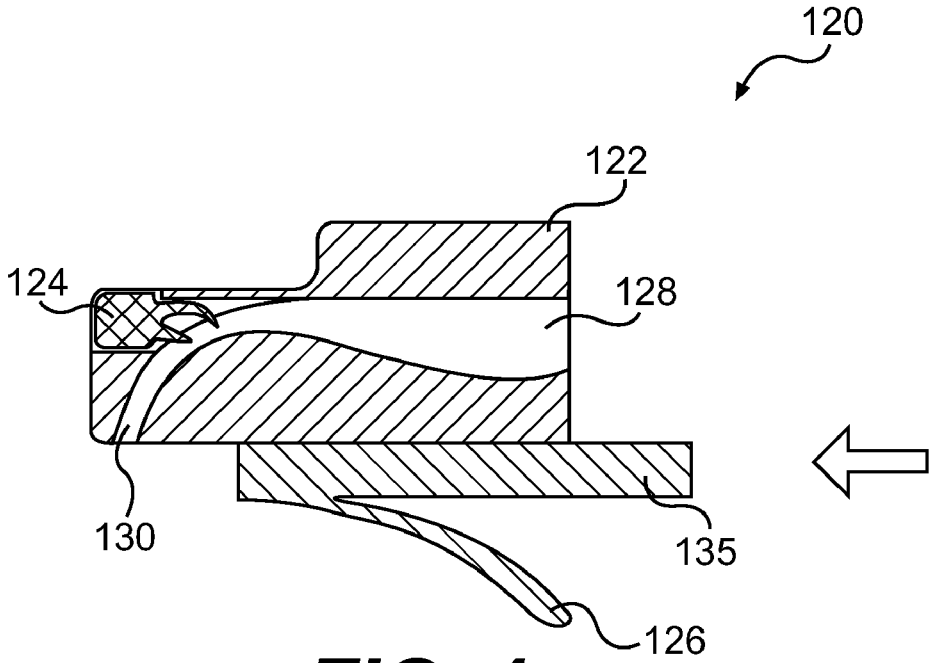
FIG. 4 is a cross-sectional side view of a RJ modular connector, in accordance with alternative embodiments of the present invention.

In the alternative embodiment illustrated in FIG. 4, the cavities that receive the wires are sloped downward such that the wires protrude from the bottom of the connector. The embodiment of FIG. 4 has a sliding bottom mechanism 135 that shears the wire ends and covers the holes. In the embodiments illustrated in FIG. 4, connector 120 comprises a connector body 122, in which an internal cavity is defined. The internal cavity of connector 120 comprises (i) a rearward chamber 128 for receiving a portion of the insulated cable via an opening defined in the rear wall and (ii) a plurality of substantially parallel passages 130 (one of which is illustrated) for receiving the insulated wires. In connector 120, the internal cavity has an alternative configuration in which the parallel passages 130 extend from the rearward passage to the bottom of the connector body. As such, the sliding mechanism 135 of connector 120 is on the bottom of the connector body. As with the connector of FIGS. 1A and 1B, connector 120 of FIG. 4 comprises a plurality of slots for receiving contact blades 124. As with other connectors of this type, connector 120 has a resilient release lever 126 (in this embodiment, the release lever 126 is attached to the sliding mechanism 135).

Figure 5A:
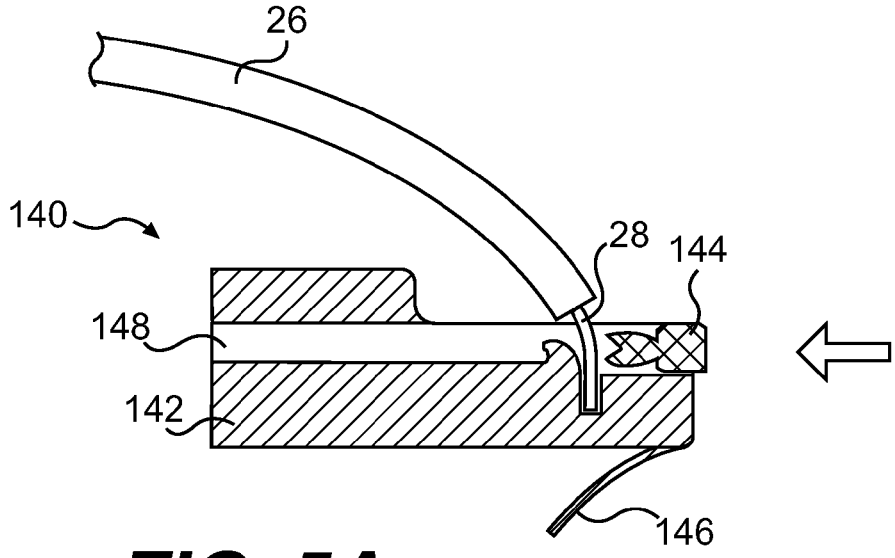
FIG. 5A is a cross-sectional side view of a RJ modular connector, illustrating the process of inserting a cable, in accordance with alternative embodiments of the present invention.
Figure 5B:
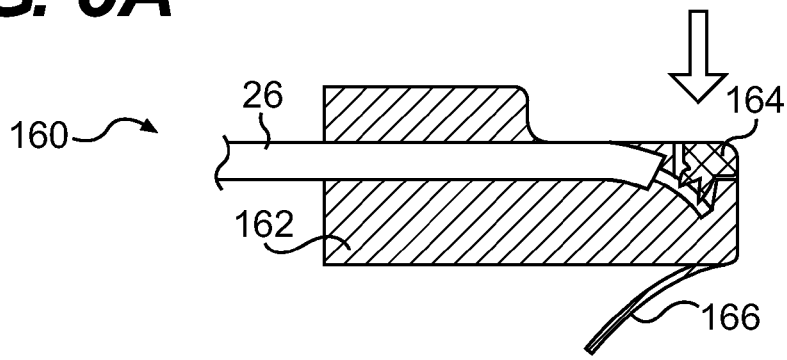
FIG. 5B is a cross-sectional side view of the connector of FIG. 5A, illustrating an inserted cable.
Figure 5C:
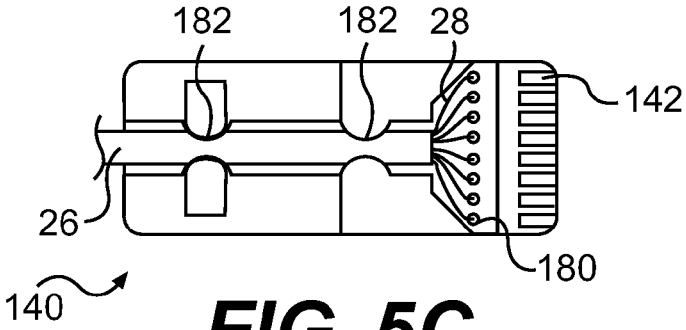
FIG. 5C is a top view of the connector of FIG. 5A, illustrating an inserted cable.
Figure 5D:
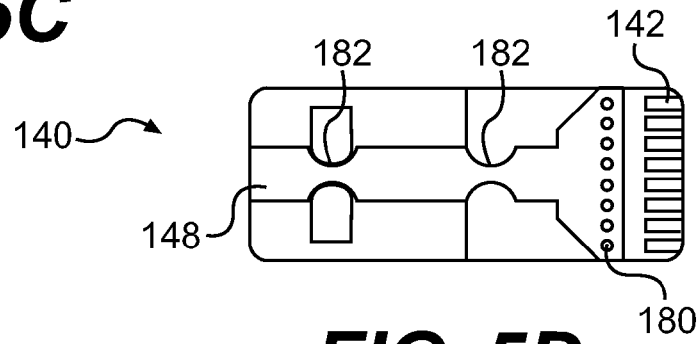
FIG. 5D is a top view of the connector of FIG. 5A, without a cable.

In an alternative embodiment illustrated in FIGS. 5A-C, an open channel is formed in the top of the connector to receive the unstripped cable and a number of smaller channels receive the stripped wires. Referring now to FIG. 5A, connector 140 comprises a connector body 142 in which an open channel 148 is defined within the top of the connector body for receiving the insulated cable 26. A plurality of parallel passages (not labeled) are defined within the connector body for receiving respective ones of the plurality of insulated wires 28 (FIG. 5A illustrates an insulated wire in one of the parallel passages). Each of the parallel passages extend from a respective one of a plurality of openings 180 (in FIGS. 5C and 5D) defined in the top of the connector body downward into the connector body. As seen in FIGS. 5C and 5D, the plurality of openings are adjacent the front end of the open channel.

A plurality of slots 142 are defined in the connector body, each slot being open to the front wall and to the top of the connector body and substantially parallel to the side walls. Each slot is configured to receive a contact blade 144, and each slot has an opening to a respective one of the parallel passages such that the piercing points of the contact blades pierce a respective insulated wire when a respective contact blade is fully inserted. In the embodiment of FIG. 5A, each slot is configured to receive a contact blade inserted in a direction along a longitudinal axis of the connector (as illustrated by the arrow). Connector 140 has several restrictions 182 formed along the edges of the open channel for frictionally securing the insulated cable in the channel (as illustrated in FIGS. 5C and 5D). As with other connectors of this type, connector 140 has a resilient release lever 146.

In one embodiment, the parallel passages extend down into but not all the way through the connector body. In an alternative embodiment (not illustrated), the parallel passages extend from the plurality of openings defined in the top of the connector body downward into and through the connector body and to respective ones of a plurality of openings defined in the bottom of the connector body. In this alternative embodiment, the free end of each of the insulated wires protrudes through a respective one of a plurality of openings defined in the bottom of the connector body prior to being sheared off. In this alternative embodiment, the connector may further comprise a sliding mechanism slidably engaged with the connector body that is configured to cover the plurality of openings defined in the bottom of the connector body when in a closed position and to enable the free end of each of the insulated wires to protrude from the bottom openings when in an open position. The forward end of the sliding mechanism may have a shearing edge for shearing the protruding insulated wires when the sliding mechanism is moved from the open position to the closed position. The sliding mechanism may comprise a sleeve that partially surrounds at least the bottom and the side walls of the connector body. The bottom of the connector body may comprise a shoulder substantially parallel to the front wall, such that a forward end of the sliding mechanism abuts a vertical portion of the shoulder when the sliding mechanism is in a closed position.

Referring now to FIG. 5B, connector 160 comprises a connector body 162 in which an open channel 148 is defined within the top of the connector body for receiving the insulated cable 26. A plurality of parallel passages (not labeled) are defined within the connector body for receiving respective ones of the plurality of insulated wires 28 (FIG. 5B illustrates an insulated wire in one of the parallel passages). Each of the parallel passages extend from a respective one of a plurality of openings 180 (in FIGS. 5C and 5D) defined in the top of the connector body downward into the connector body. The parallel passages angle downward into the connector body at an angle of between five degrees and ninety degrees.

A plurality of slots are defined in the connector body, each slot being open to the front wall and to the top of the connector body and substantially parallel to the side walls. Each slot is configured to receive a contact blade 164, and each slot has an opening to a respective one of the parallel passages such that the piercing points of the contact blades pierce a respective insulated wire when a respective contact blade is fully inserted. In the embodiment of FIG. 5B, each slot is configured to receive a contact blade inserted in a direction perpendicular to a longitudinal axis of the connector (as illustrated by the arrow in FIG. 5B). As with other connectors of this type, connector 160 has a resilient release lever 166.

In either the embodiment of FIG. 5A or of 5B, the stripped wires are placed vertically into the parallel passages, each of which is sized to snugly receive a stripped wire. The cable is then lowered into the large open channel while the stripped wires remain in the smaller channels, resulting in the wires being sloped downwardly but not exiting the connector (FIG. 5B). The large channel includes restrictions that grab and hold the cable 26. The contact blades may be inserted horizontally from the front (FIG. 5A) or vertically from the top (FIG. 5B) and may have uneven prongs due to the slope of the inserted wire (FIG. 5B).

In embodiments of the invention, the orientation of the contact blades set inward as opposed to downward shorten the distance that the untwisted wires must extend to meet the contact blades, thereby further reducing "cross-talk". The modular connector as described above may be molded in two or more interlocking sections.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A modular connector for terminating an insulated cable, the insulated cable having a jacket encasing a plurality of insulated wires, the modular connector comprising:

a connector body having two substantially parallel side walls, a top, a bottom, a front wall, and a rear wall that is substantially parallel to the front wall; and a plurality of conductive contact blades, each contact blade comprising at least one piercing point;

wherein an internal cavity is defined within the connector body, the internal cavity comprising (i) a rearward chamber for receiving a portion of the insulated cable via an opening defined in the rear wall and (ii) a plurality of substantially parallel passages for receiving respective ones of the plurality of insulated wires, each of the parallel passages extending from the rearward chamber of the internal cavity to a respective one of a plurality of openings defined in the bottom of the connector body through which a free end of each of the insulated wires protrudes prior to being sheared off;

wherein a plurality of slots are defined in the connector body, each slot being open to the front wall and to the top, each slot being substantially parallel to the side walls, each slot being configured to receive a respective one of the contact blades inserted in a direction along a longitudinal axis of the connector, each slot having an opening to a respective one of the parallel passages such that a respective at least one piercing point pierces a respective insulated wire when a respective contact blade is fully inserted; and further comprising a sliding mechanism slidably engaged with the connector body, the sliding mechanism configured to cover the plurality of openings defined in the bottom of the connector body when in a closed position and to enable the free end of each of the insulated wires to protrude from the openings when in an open position.

2. The connector of claim 1, wherein the parallel passages meet the bottom of the connector body at a substantially perpendicular angle.

3. The connector of claim 2, wherein the contact blades comprise two piercing points, and wherein the two piercing points have substantially equal lengths such that each piercing point pierces the respective insulated wire to substantially the same depth.

4. The connector of claim 1, wherein the parallel passages meet the bottom of the connector body at an angle of between five degrees and ninety degrees.

5. The connector of claim 4, wherein the contact blades comprise two piercing points, and wherein a length of each piercing point is selected such that each piercing point pierces the respective insulated wire to substantially the same depth.

6. The connector of claim 1, wherein a forward end of the sliding mechanism comprises a shearing edge for shearing the protruding insulated wires when the sliding mechanism is moved from the open position to the closed position.

7. The connector of claim 1, wherein the sliding mechanism comprises a sleeve that partially surrounds at least the bottom and the side walls of the connector body.

8. The connector of claim 1, wherein the bottom of the connector body comprises a shoulder substantially parallel to the front wall, such that a forward end of the sliding mechanism abuts a vertical portion of the shoulder when the sliding mechanism is in a closed position.

9. The connector of claim 1, wherein the sliding mechanism further comprises a resilient release lever, one end of which is affixed to a front edge of the sliding mechanism.

10. A modular connector for terminating an insulated cable, the insulated cable having a jacket encasing a plurality of insulated wires, the modular connector comprising:

a connector body having two substantially parallel side walls, a top, a bottom, a front wall, and a rear wall that is substantially parallel to the front wall; and a plurality of conductive contact blades, each contact blade comprising at least one piercing point;

wherein an open channel is defined within the top of the connector body for receiving the insulated cable;

wherein a plurality of parallel passages are defined within the connector body for receiving respective ones of the plurality of insulated wires, each of the parallel passages extending from a respective one of a plurality of openings defined in the top of the connector body downward into the connector body, the plurality of openings being adjacent a front end of the open channel; and wherein a plurality of slots are defined in the connector body, each slot being open to the front wall and to the top, each slot being substantially parallel to the side walls, each slot being configured to receive a respective one of the contact blades, each slot having an opening to a respective one of the parallel passages such that a respective at least one piercing point pierces a respective insulated wire when a respective contact blade is fully inserted.

11. The connector of claim 10, wherein each slot is configured to receive a respective one of the contact blades inserted in a direction along a longitudinal axis of the connector.

12. The connector of claim 10, wherein each slot is configured to receive a respective one of the contact blades inserted in a direction perpendicular to a longitudinal axis of the connector.

13. The connector of claim 10, wherein each of the parallel passages extend from a respective one of the plurality of openings defined in the top of the connector body downward into and through the connector body and to respective ones of a plurality of openings defined in the bottom of the connector body.

14. The connector of claim 13, wherein a free end of each of the insulated wires protrudes through a respective one of a plurality of openings defined in the bottom of the connector body prior to being sheared off.

15. The connector of claim 13, further comprising a sliding mechanism slidably engaged with the connector body, the sliding mechanism configured to cover the plurality of openings defined in the bottom of the connector body when in a closed position and to enable the free end of each of the insulated wires to protrude from the bottom openings when in an open position.

16. The connector of claim 15, wherein a forward end of the sliding mechanism comprises a shearing edge for shearing the protruding insulated wires when the sliding mechanism is moved from the open position to the closed position.

17. The connector of claim 15, wherein the sliding mechanism comprises a sleeve that partially surrounds at least the bottom and the side walls of the connector body.

18. The connector of claim 15, wherein the bottom of the connector body comprises a shoulder substantially parallel to the front wall, such that a forward end of the sliding mechanism abuts a vertical portion of the shoulder when the sliding mechanism is in a closed position.

19. The connector of claim 10, wherein at least one restriction is formed along one or more edges of the open channel for frictionally securing the insulated cable in the channel.

20. The connector of claim 10, wherein the parallel passages angle downward into the connector body at an angle of between five degrees and ninety degrees.

21. The connector of claim 20, wherein the contact blades comprise two piercing points, and wherein a length of each piercing point is selected such that each piercing point pierces the respective insulated wire to substantially the same depth.

* * * * *